US009247359B2

(12) United States Patent
Lafort et al.

(10) Patent No.: US 9,247,359 B2
(45) Date of Patent: Jan. 26, 2016

(54) TRANSDUCER, A HEARING AID COMPRISING THE TRANSDUCER AND A METHOD OF OPERATING THE TRANSDUCER

(71) Applicant: Sonion Nederland BV, Hoofddorp (NL)

(72) Inventors: Adrianus Maria Lafort, Delft (NL); Andreas Tiefenau, Koog a/d Zaan (NL); Anne-Marie Sänger, Koog a/d Zaan (NL); Frederik Cornelis Blom, Utrecht (NL); Alwin Fransen, Den Hoorn (NL)

(73) Assignee: Sonion Nederland BV, Hoofddorp (NL)

( * ) Notice: Subject to any disclaimer, the term of this patent is extended or adjusted under 35 U.S.C. 154(b) by 0 days.

(21) Appl. No.: 14/057,475

(22) Filed: Oct. 18, 2013

(65) Prior Publication Data

US 2014/0112509 A1 Apr. 24, 2014

Related U.S. Application Data

(60) Provisional application No. 61/759,235, filed on Jan. 31, 2013, provisional application No. 61/715,690, filed on Oct. 18, 2012.

(51) Int. Cl.

| | |
|---|---|
| ***H04R 1/24*** | (2006.01) |
| ***H04R 25/00*** | (2006.01) |
| ***H04R 1/40*** | (2006.01) |
| *H04R 1/38* | (2006.01) |
| *H04R 1/02* | (2006.01) |
| *H04R 1/28* | (2006.01) |

(52) U.S. Cl.

CPC ..... *H04R 25/65* (2013.01); *H04R 1/24* (2013.01); *H04R 1/406* (2013.01); *H04R 25/405* (2013.01); *H04R 1/02* (2013.01); *H04R 1/28* (2013.01); *H04R 1/38* (2013.01)

(58) Field of Classification Search

USPC ..... 381/182, 355, 356

See application file for complete search history.

(56) References Cited

U.S. PATENT DOCUMENTS 3,770,911 A * 11/1973 Knowles et al. ..... 381/313
3,995,124 A 11/1976 Gabr (Continued)

FOREIGN PATENT DOCUMENTS

DE 10 2010 021157 11/2011
WO WO 2011/015674 A1 2/2011

OTHER PUBLICATIONS

European Search Report, European Application No. EP 13 18 9277, dated Mar. 19, 2015, 3 pages.

(Continued)

*Primary Examiner* — Davetta W Goins
*Assistant Examiner* — Amir Etesam
(74) *Attorney, Agent, or Firm* — Nixon Peabody LLP

(57) ABSTRACT

The invention relates to a transducer comprising a housing, a first and a second diaphragm, and a first and a second signal provider. The housing comprises an inner surface. The first and second diaphragms are positioned in the housing. The first and second diaphragms define a common compartment being delimited by at least both a part of the inner surface and the first and second diaphragms. The first signal provider is configured to convert movement of the first diaphragm into a first signal. The second signal provider is configured to convert movement of the second diaphragm into a second signal. The transducer can be used in a hearing aid.

21 Claims, 10 Drawing Sheets

(56) References Cited

U.S. PATENT DOCUMENTS 6,782,109 B2 8/2004 Sheplak et al. ..... 381/191
6,788,796 B1 9/2004 Miles et al.
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Haltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosch et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,856,113 B2 * 12/2010 Yang ..... H04R 5/027 381/355
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
2005/0135641 A1 6/2005 Akino
2005/0213432 A1 * 9/2005 Hoshuyama ..... 367/129
2007/0047746 A1 * 3/2007 Weigold et al. ..... 381/174
2007/0121982 A1 * 5/2007 van Halteren ..... H04R 1/04 381/337
2007/0127759 A1 * 6/2007 Zhang et al. ..... 381/338
2007/0189563 A1 * 8/2007 Sjursen et al. ..... 381/321
2009/0214062 A1 8/2009 Reining
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 van Halteren
2013/0195295 A1 8/2013 van Halteren et al.
2014/0112507 A1 4/2014 van Halteren ..... 381/313

OTHER PUBLICATIONS

European Search Report for European Application No. EP 13 18 9276 dated Mar. 9, 2015 (2 pages).

* cited by examiner

TRANSDUCER, A HEARING AID COMPRISING THE TRANSDUCER AND A METHOD OF OPERATING THE TRANSDUCER

REFERENCE TO RELATED APPLICATIONS

This application claims the benefit of U.S. Provisional Patent Application No. 61/759,235, filed Jan. 31, 2013, and titled "Transducer, A Hearing Aid Comprising The Transducer And A Method Of Operating The Transducer," and U.S. Provisional Application No. 61/715,690, filed on Oct. 18, 2012, and titled "Transducer, A Hearing Aid Comprising The Transducer And A Method Of Operating The Transducer," each of which is incorporated by reference herein in its entirety.

FIELD OF THE INVENTION

The present invention relates to a transducer which may be used both as a directional sound receiver and an omnidirectional sound receiver.

BACKGROUND OF THE INVENTION

Usually, directional sensitivity in, for example, hearing aids is achieved by using (i) matched pairs of two omnidirectional microphones or (ii) analogue directional microphones.

Using omnidirectional microphones, directional hearing in hearing aids is normally achieved by the use of a matched pair of two omnidirectional microphones. Two operational modes exist: directional and omnidirectional mode. In the directional mode, the signals of both microphones are subtracted. An electrical time delay is applied to one of the signals. In the omnidirectional mode, either only one of the microphones is used or the signals of both microphones are added, which leads to a 3 dB better SNR.

Instead of using omnidirectional microphones, directional hearing in a hearing aid can also be achieved by the use of an analogue directional microphone. An analogue directional microphone is a microphone with a second sound inlet in the rear volume, wherein one of the sound inlets has an acoustical filter to achieve a time delay. The membrane only detects pressure differences between the front and the rear sound inlet. Therefore, the analogue directional microphone only works in directional mode. The advantage of an analogue directional microphone is that directionality cannot be degraded by drift over time.

These types of systems have advantages and disadvantages. For example, matched pairs of two omnidirectional microphones typically have the following characteristics:

- Double space and energy consumption of an omnidirectional microphone.
- If the sensitivity and/or phase of the two microphones of a matched pair drift away from each other over time by aging effects or on shorter time scales due to environmental influences directional performance in the low frequencies degrades quickly.
- Low signal-to-noise-ratio in directional mode in the low frequencies which makes it necessary to switch to omnidirectional mode in quiet situations.

And, analogue directional microphones typically have the following characteristics:

- The delay has to be made with acoustic filters such as external tubing or grids and cannot be changed. Therefore, directionality can only be static (no dynamic beam forming).

- Low signal-to-noise-ratio in the low frequencies. Switching to omnidirectional mode not possible; thus requiring an additional omnidirectional microphone.

Examples of systems of the above types may be seen in U.S. Pat. Nos. 7,245,734 and 6,788,796.

DESCRIPTION OF THE INVENTION

In a first aspect, the invention relates to a transducer comprising a housing, a first and a second diaphragm, and a first and a second signal provider. The housing comprises an inner surface. The first and second diaphragms are positioned in the housing. The first and second diaphragms define a common compartment being delimited by at least both a part of the inner surface and the first and second diaphragms. The first signal provider is configured to convert movement of the first diaphragm into a first signal. The second signal provider is configured to convert movement of the second diaphragm into a second signal.

In the present context, a transducer is a converter converting sound into a signal, usually an electrical signal, or vice versa. Naturally, the output signal may alternatively be an optical signal, a wireless signal or the like. A typical type of transducer of this type is a microphone.

The housing may be a monolithic housing, but will typically be provided as a number of parts combinable into the housing. A typical type of housing is obtained by assembling or combining two half shells or a shell part and a lid part.

The inner surface takes part in the delimiting the common compartment. Naturally, not all of the inner surface is present in the common compartment, and other elements may be provided or positioned within the housing and may thus also take part in the delimiting of the common compartment. A processor and/or wires, as well as vibration sensors may be positioned within the housing and will then also delimit the common compartment. A diaphragm, also called a membrane, is usually a very thin element configured to vibrate when sound impinges thereon. This vibration is sensed by the pertaining signal provider and a signal is output. This signal preferably corresponds to the sound, such as in frequency and amplitude. Naturally, a distortion or filtering may take place so that the frequency contents of the sound and the output signal need not correspond entirely.

A signal provider is an element which is adapted to output a signal in response to vibration or movement of a diaphragm. A typical type of signal provider is one wherein the diaphragm is positioned adjacent to a so-called back plate and where one of the diaphragm and the back plate is permanently charged. A signal may be derived from the other of the back plate and the diaphragm which corresponds to the distance between the diaphragm and back plate. Naturally, this distance varies with the movement of the diaphragm.

Another type of signal provider transfers movement of the diaphragm into movement of an element extending between a pair of magnets and through a coil, whereby this movement causes a varying current to flow in the coil.

Another type of signal provider may be comprised in a MEMS structure also incorporating the diaphragm.

Naturally, the signal providers may be of the same type or different types.

The common compartment is delimited by both the first and second diaphragms. When the diaphragms comprise a first side and a second side, the second sides then face the common compartment.

In one embodiment, the housing has openings allowing sound from the surroundings of the housing to impinge on the diaphragms. The diaphragms may be positioned within the housing or at an outer edge thereof, such as in the actual openings. One example would be a tube shaped housing being closed at the ends, forming the openings, by the diaphragms.

In one embodiment, the common compartment is acoustically sealed from surroundings of the housing. Thus, no sound opening is provided into the compartment, so that sound entering the compartment enters via the movement/vibration of the diaphragms only. It is noted that a vent may be provided, where a vent is an opening allowing air or gas passage into or out of the compartment. The vent may comprise one or more openings. It is desired that the venting of the transducer has no audio output. This venting is often denoted a DC venting. Thus, the vent channel or opening is selected sufficiently narrow for air/gas to pass, but so that no audible frequencies are supported.

In a particularly interesting embodiment, the housing further comprises a first and a second compartment and the openings comprise a first sound opening and a second sound opening that open into the first and second compartment, respectively. The first side of the first diaphragm defines, with at least a part of the inner surface of the housing, the first compartment. The first side of the second diaphragm defines, with at least a part of the inner surface of the housing, the second compartment.

The inner surface takes part in the delimiting of the compartment(s). Naturally, other elements may be provided or positioned within the housing and may thus also take part in the delimiting of the compartment(s). A processor and/or wires, as well as vibration sensors may be positioned within the housing and will then also take part in the delimiting of at least one of the compartments.

At least two sound openings are then provided in the housing. These are configured to guide sound from the surroundings, or sound guides external to the housing, into the first and second compartments, respectively. The diaphragms now define, together optionally with other elements, three compartments in the housing. The first compartment is preferably delimited by the first diaphragm, but not the second diaphragm, so that sound entering the first sound opening directly may impinge on the first diaphragm but not the second diaphragm. At the same time, the second compartment is preferably delimited by the second diaphragm, but not the first diaphragm, so that sound entering the second sound opening directly may impinge on the second diaphragm but not the first diaphragm. No sound entering the first or second sound openings preferably can enter the common compartment directly. However, sound or vibrations generated by one of the first and second diaphragms may, via the common compartment, impinge on the other of the first and second diaphragms. In one embodiment, the first and second compartments have at least substantially the same size, defined as a volume thereof, and/or the same dimensions. This has an advantage when the signals from the two signal providers are subtracted, added or summed, as will be described further below.

In one embodiment, the first and second diaphragms have at least substantially the same size, weight, thickness, and/or stiffness, so that the same sound will generate at least substantially the same deflection or movement of the diaphragm.

The performance of a transducer as described can be expressed by the ratio of the acoustical compliance of either one of the diaphragms and the acoustical compliance of the common compartment as follows:

$$\frac{C_D}{C_{CC}}.$$

Operational performance in directional mode determines a lower limit of the ratio. Operational performance in omnidirectional mode determines an upper limit of the ratio. This holds true for the first and second diaphragm having the same acoustical compliance, as well as for a single diaphragm of which first and second parts form the first and second diaphragms, each having the same acoustical compliance.

In one embodiment, the transducer further comprises a sound filtering element dividing the common compartment into a third compartment and a fourth compartment. The third compartment is delimited by the sound filtering element, (at least part of) the inner surface, the first diaphragm and the second diaphragm. The fourth compartment is delimited by the sound filtering element and (at least part of) the inner surface, but not the first and the second diaphragm.

Thus, the filter provides a cut-off frequency above which the membranes only see the third compartment. Below the cut-off frequency, the membranes see the sum of the third and fourth compartment.

In another embodiment, the transducer further comprises a sound filtering element dividing the common compartment into a third compartment and a fourth compartment. The third compartment is delimited by the sound filtering element, (at least part of) the inner surface and the first diaphragm but not the second diaphragm. The fourth compartment delimited by the sound filtering element, (at least part of) the inner surface and the second diaphragm but not the first diaphragm.

Thus, vibration of one diaphragm will not cause unhindered vibration of the other via the common chamber, as any air or gas transport from one diaphragm to the other via this chamber is acoustically filtered.

For both embodiments with a sound filter, the sound filter may be a wall having therein an opening, the dimensions of which defines the filtering characteristics. Other types of filters may be channels, openings, foams or the like.

Naturally, the sound filter may be gas penetrable, as a channel would normally be. In another embodiment, the sound filter may comprise yet another diaphragm or membrane preventing gas flow from the first diaphragm to the second while allowing vibrations or sound flow. In yet another embodiment, the sound filtering element comprises multiple sound filtering parts such as additional acoustic chambers, volumes or tubes.

Preferably, the sound filter is a low pass filter, such as filter having a damping of 3 dB or more of frequencies above 10 Hz, such as above 20 Hz, such as above 30 Hz, such as above 40 Hz, such as above 50 Hz, such as above 60 Hz, such as above 70 Hz, such as above 80 Hz, such as above 90 Hz, such as above 100 Hz, such as above 110 Hz, such as above 120 Hz, such as above 130 Hz, such as above 140 Hz, such as above 150 Hz, such as above 160 Hz, such as above 170 Hz, such as above 180 Hz, such as above 190 Hz, such as above 200 Hz, such as above 210 Hz, such as above 220 Hz, such as above 230 Hz, such as above 240 Hz, such as above 250 Hz, such as above 260 Hz, such as above 270 Hz, such as above 280 Hz, such as above 290 Hz, such as above 300 Hz, such as above 310 Hz, such as above 320 Hz, such as above 330 Hz, such as above 340 Hz, such as above 350 Hz, such as above 360 Hz, such as above 370 Hz, such as above 380 Hz, such as above 390 Hz, such as above 400 Hz, such as above 410 Hz, such as above 420 Hz, such as above 430 Hz, such as above 440 Hz, such as above 450 Hz, such as above 460 Hz, such as above 470 Hz, such as above 480 Hz, such as above 490 Hz, such as above 500 Hz, such as above 510 Hz, such as above 520 Hz, such as above 530 Hz, such as above 540 Hz, such as above 550 Hz, such as above 560 Hz, such as above 570 Hz, such as above 580 Hz, such as above 590 Hz, such as above 600 Hz, such as above 610 Hz, such as above 620 Hz, such as above 630 Hz, such as above 640 Hz, such as above 650 Hz, such as above 660 Hz, such as above 670 Hz, such as above 680 Hz, such as above 690 Hz, such as above 700 Hz, such as above 710 Hz, such as above 720 Hz, such as above 730 Hz, such as above 740 Hz, such as above 750 Hz, such as above 760 Hz, such as above 770 Hz, such as above 780 Hz, such as above 790 Hz, such as above 800 Hz.

Alternatively, the filter is a high pass filter such as filter having a damping of 3 dB or more of frequencies below 20000 Hz, such as below 19000 Hz, such as below 18000 Hz, such as below 17000 Hz, such as below 16000 Hz, such as below 15000 Hz, such as below 14000 Hz, such as below 13000 Hz, such as below 12000 Hz, such as below 11000 Hz, such as below 10000 Hz, such as below 9000 Hz, such as below 8000 Hz, such as below 7000 Hz, such as below 6000 Hz, such as below 5000 Hz, such as below 4000 Hz, such as below 3000 Hz, such as below 2000 Hz, such as below 1000 Hz.

Naturally, any of the above filter thresholds may be combined to provide a band pass filter having one filter threshold of the low pass filter thresholds and another threshold being one of the above high pass filter thresholds.

In one embodiment, the transducer further comprises at least one further diaphragm delimiting the common compartment and at least one further signal provider. The diaphragm has first and second sides. The second side faces the common compartment. The further signal provider is configured to convert movement of the further diaphragm into a further signal. The housing comprises at least one further compartment defined by the first side of the further diaphragm and at least a part the inner surface. The openings comprise at least one further opening that opens into the respective at least one further compartment. This allows additional ways of picking up and processing sound from the surroundings.

Another interesting embodiment is one wherein the transducer further comprises a processor configured to receive the first and the second signals and output a third signal and a fourth signal. The third signal is based on an addition of the first and second signals and the fourth signal is based on a subtraction of the first and second signals.

This processor may be provided inside or outside the housing, and it may be embodied as a single processor or chip or a number of distributed processors or chips. An advantage of a single chip is power saving, and when positioning the processor inside the housing, the overall space required by the transducer is reduced. When the processor is provided inside the housing, it will take up space and take part in the definition of the compartment(s).

The transducer may have electrically conducting elements from which these signals may be derived from outside the transducer. Additional conducting elements may be provided for providing power to the processor and optionally the signal providers.

The processor may be an ASIC, DSP or any other type of processing electronics.

When generating the fourth signal, the low pass filtering of the sound filter may be especially interesting, as the low pass filtering will make the two diaphragm/sensor element systems behave, at the higher frequencies, as a directional microphone. The directionality is reduced, but the sensitivity is increased at the lower frequencies, which corresponds to the operation of a matched pair.

When generating the fourth signal, the processor is preferably configured to provide the fourth signal by initially time delaying one of the first and second signals and subsequently subtracting the time delayed first or second signal and the other of the first and second signals. This time delay is usual in relation to the operation of multiple-microphone set-ups.

When generating the third signal, the processor may provide the third signal by initially time delaying one of the first and second signals and subsequently adding the time delayed first or second signal and the other of the first and second signals. For both signals generated, the time delay may be variable depending on different situations. In a specific embodiment, the processor is provided with an input terminal for receiving a signal to set the desired time delay.

The operation of adding and subtraction may also be performed with scaled version of the first and second signals. This is of particular interest when three or more diaphragms and respective signals are provided.

Another aspect of the invention relates to a hearing aid comprising a transducer according to the first aspect of the invention. The hearing aid further comprises:

- a hearing aid housing comprising a first and a second hearing aid sound inputs and a hearing aid transducer compartment in which the transducer is positioned,
- a sound generator, and
- a processor configured to receive the first and second signals and output an output signal for the sound generator based on the first and second signals.

The hearing aid housing normally will be different from the transducer housing, but the transducer housing may form part of the hearing aid housing, if desired. The first and second signals may be provided over electrical wires provided from the transducer to the processor. The processor may be provided inside the transducer then having an output for the signal for the sound generator.

The sound generator may receive a signal from the processor via electrical wires, an optical cable and/or a wireless connection. The sound generator may be based on any technology and may be a miniaturized loudspeaker, a so-called receiver, for use in hearing aids. Different technologies are used in such equipment for generating the sound, and the present invention puts no limitations on such technologies.

The hearing aid may comprise a sound output, and the sound generator may be positioned at the sound output or a sound guide may be provided between the sound generator and the sound output.

It is noted that the hearing aid may comprise a single housing or multiple, distributed housings. In one embodiment, the hearing aid has a first housing in which the transducer is positioned and a second housing wherein the sound generator and/or the sound output is positioned. The first housing may be positioned outside the ear of the person, such as on or behind the user's ear in order for sound to be better sensed. The sound inputs may then be positioned so that a direction defined thereby may be directed e.g. to the front of the user.

At the same time, the sound may be generated or output into the ear canal of the user, when the second housing is positioned at or within the ear canal of the user.

The sound generator may be positioned within the second housing and may then receive the pertaining signals from the processor via wires or the like extending between the first and second housings. Alternatively, the sound generator may be positioned in the first housing and the sound guided from the first to the second housing in, for example, a sound guide.

Naturally, the diaphragms of the transducer may be directly exposed to the surroundings, but as these normally are quite fragile, it is preferred that these are protected, such as within the above mentioned first and second compartments.

In that situation, the transducer may form part of an outer surface of the hearing aid housing so that the sound inputs of the transducer may be positioned also in the outer surface of the hearing aid housing.

In another situation, the hearing aid further comprises (i) a first sound guide configured to transport sound from the first hearing aid sound input to the first diaphragm and/or sound opening, and (ii) a second sound guide configured to transport sound from the second hearing aid sound input to the second diaphragm and/or sound opening.

When the transducer has no sound openings, such as when the transducer has no first and/or second chambers, the sound guide may transport the sound to the diaphragm(s). When the transducer has first/second chambers and sound openings, the sound guides may transport the sound thereto and consequently also to the diaphragms. Naturally, the set-up may be different in relation to the first and second diaphragms.

These sound guides may be tube-shaped or simply be defined as chambers, spaces, openings or the like between the hearing aid housing and the transducer housing. Optionally, further elements may be provided for completing such sound guides.

Preferably, the first and second sound guides do not share any volume, so that sound guided by the first sound guide is not, at any time, mixed with that guided by the second sound guide.

In one embodiment, the common compartment of the transducer is further delimited by at least a part of an inner surface of the hearing aid transducer compartment. This allows the common compartment to be composed by an inner volume of the hearing aid and an inner volume of the transducer. Accordingly, the transducer may have smaller dimensions and takes advantage of space available in the hearing aid.

A final aspect of the invention relates to a method of operating the transducer according to the first aspect of the invention. The method comprises (i) generating and outputting a third signal from an addition of the first and second signals, and (ii) generating and outputting a fourth signal from a subtraction of the first and second signals.

These signals may be generated and output simultaneously or sequentially, such as when instructed to do so by, for example, an operator. The transducer may comprise an instructing element operable by a user. The method comprises outputting the third signal, until the instructing element is operated, where after the fourth signal is output. Naturally, another operation of the instructing element may bring about outputting the third signal again. This instructing element may be a switch, such as a rocker switch, engageable from outside the housing.

The transducer as set out above and a hearing aid incorporating such a transducer, in directional mode outperforms a matched pair directional microphone, while allowing to switch between omni-directional mode and directional mode not provided by analogue directional microphones.

BRIEF DESCRIPTION OF THE DRAWINGS

In the following, preferred embodiments of the invention will be described with reference to the drawing, wherein.

Figure 1:
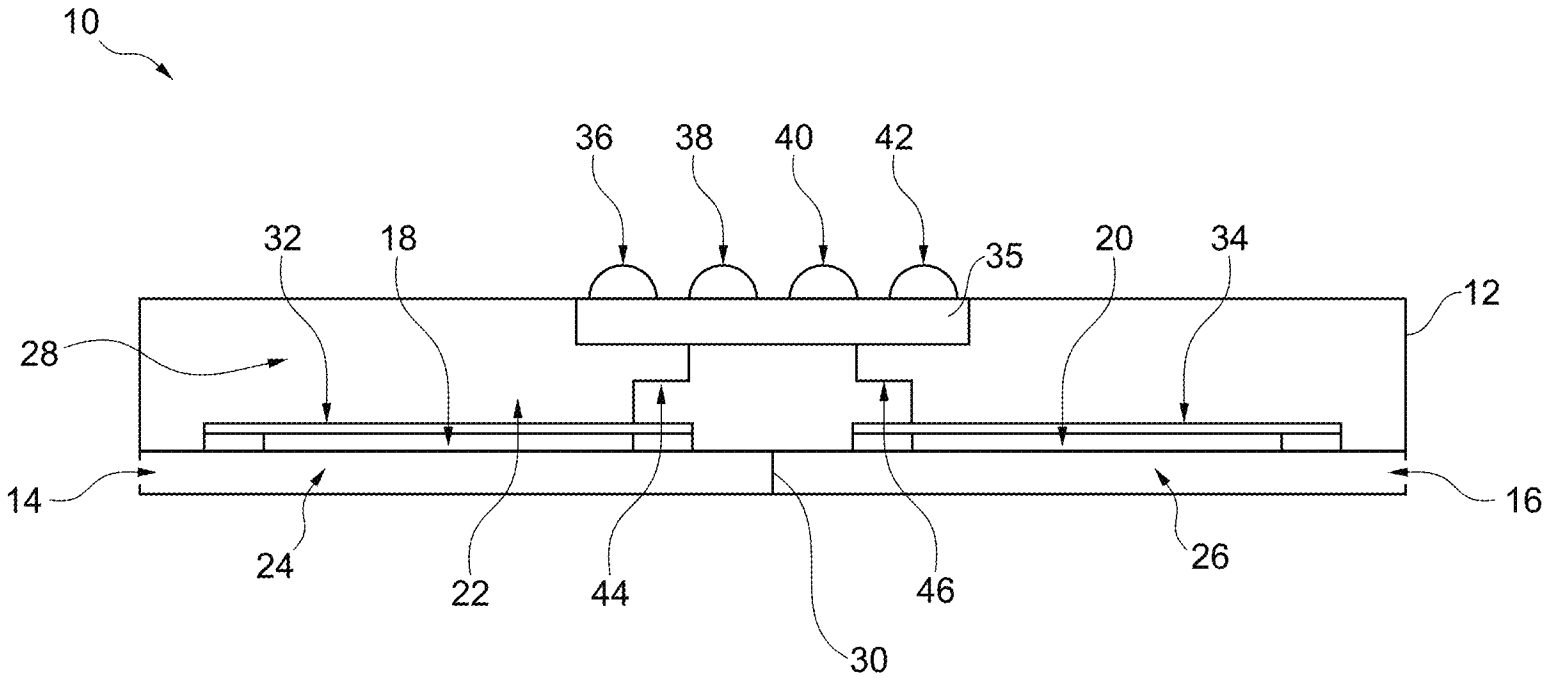
FIG. 1 illustrates a first embodiment of a transducer according to the invention.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE DRAWINGS

In FIG. 1, a first embodiment (10) is illustrated having a housing (12) having two sound inlets, Sound Inlet 1 (14) and Sound Inlet 2 (16), and wherein two membranes, Membrane 1 (18) and Membrane 2 (20) are positioned dividing the inner chamber (22) of the housing (12) into three chambers, Front Volume 1 (24), Front Volume 2 (26) and Common rear volume (28).

It is seen that the first and second front volumes (24, 26) are divided by a dividing wall (30). The housing includes two backplates, Backplate 1 (32) and Backplate 2 (34), which together with the membranes (18, 20) define sound sensors or microphones. From these sensors, signals are fed to a processor (35), IC, having two power inputs, Vdd (36) and Gnd (38), and two signal inputs (44, 46) as well as two signal outputs, Mic_1 (40) and Mic_2 (42).

The operation of the transducer of FIG. 1 is that sound travelling in the surroundings of the transducer enters the front volumes via the sound inputs and thus affects the membranes which vibrate, causing signals to be output from the sensors and fed to the processor.

In the present embodiment, the processor may be quite simple and may simply feed the input signals directly to each of the Mic_1 and Mic_2 outputs. Alternatively, a simple filtering and/or amplification may be performed. More complex types of processors will be described further below.

The two output signals Mic_1 and Mic_2 may be used in different manners. One manner may be an omnidirectional mode, where the signals of the two sensors may be added so as to provide a stronger signal representing the received and sensed sound. This corresponds to the use of two microphones for sensing the same sound in a non-directional manner.

Another manner is to provide or utilize directional properties obtained by the sound entering the two front volumes from different positions. This is a directional manner, and in this manner, one of the two sensor signals is subtracted from the other. One of the sensor signals may be delayed, such as digitally, before the subtraction.

The skilled person is well aware of how to treat the sensor signals in order to obtain the omnidirectional and/or the directional signals.

One advantage of the structure of the embodiment of FIG. 1 is that vibrations of the housing causing movement of both membranes will result in signals that cancel each other out when subtracted in directional mode.

Figure 2:
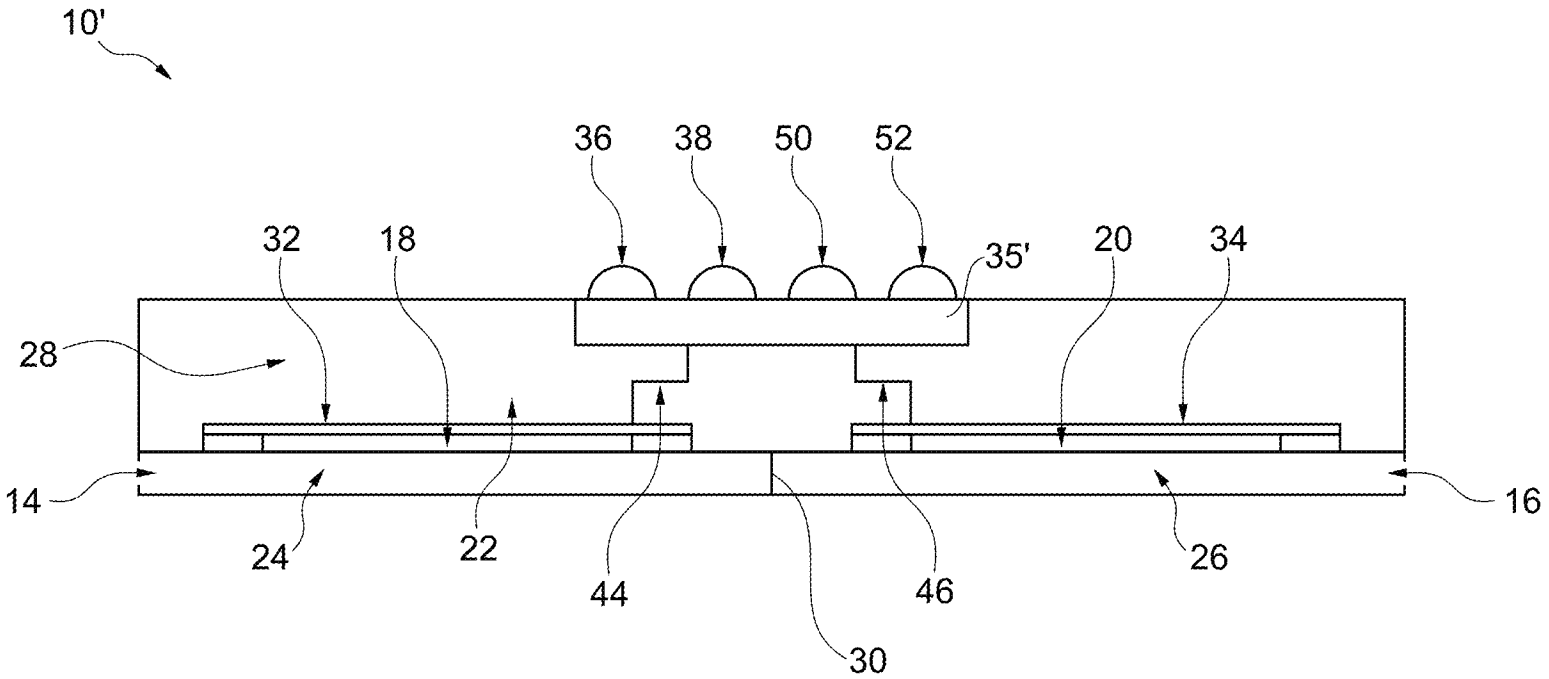
FIG. 2 illustrates a second embodiment of a transducer according to the invention.

In FIG. 2, another embodiment (10') of a transducer is seen wherein the processor (35'), IC, is more complicated in that it is configured to perform the subtraction/addition and thus to output two output signals. One signal is an omnidirectional signal, S_omni (50), based on the above addition, and another signal, S_dir (52), being a directional signal based on the above subtraction.

In FIG. 1, this processing may be performed by a processor receiving the two output signals, Mic_1 and Mic_2, whereas they are performed by the processor positioned inside the housing, which reduces the overall space requirements and may additionally reduce the power consumption in that only a single processor need be used.

Figure 3:
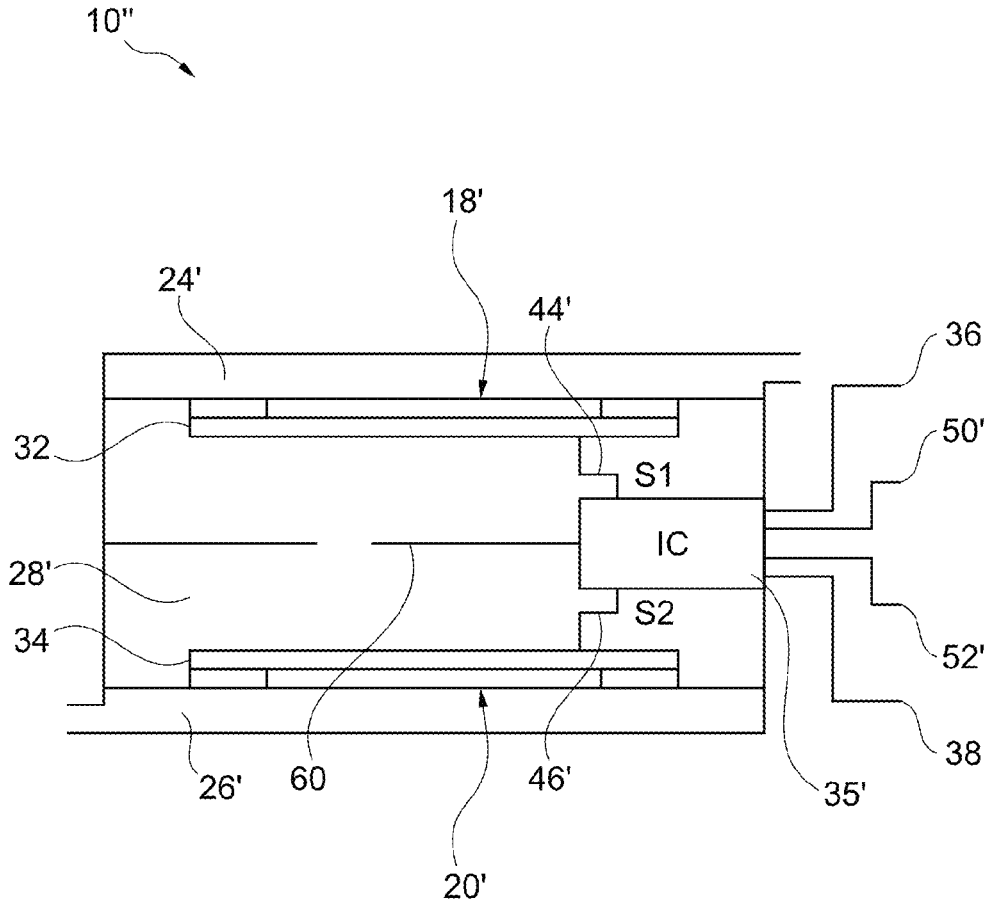
FIG. 3 illustrates a third embodiment of a transducer according to the invention.

In FIG. 3, another embodiment (10") corresponding to that of FIG. 2 is illustrated in which the internal structure of the transducer (10') is changed so that the two membranes now face each other. The first front volume (24') is above the top membrane (18'), Membrane 1, and the second front volume (26') is below the lower membrane (20'), Membrane 2, and where the common rear volume (28') is positioned between the two membranes. Again, the processor (35'), IC, receives the two sensor signals, S1 (44') and S2 (46'), and has two power inputs, Vdd (36) and Gnd (38), and outputs the two signals Omni-Out (50') and Dir-Out (52').

The overall advantage of the structure of the embodiment of FIG. 3 is that vibrations of the housing causing movement of both membranes will result in signals in counterphase, which cancel each other out when summed in omnidirectional mode.

In FIG. 3, an element (60) is indicated between the membranes and backplates. This filtering element (60) is described further in relation to FIG. 4.

Figure 4:
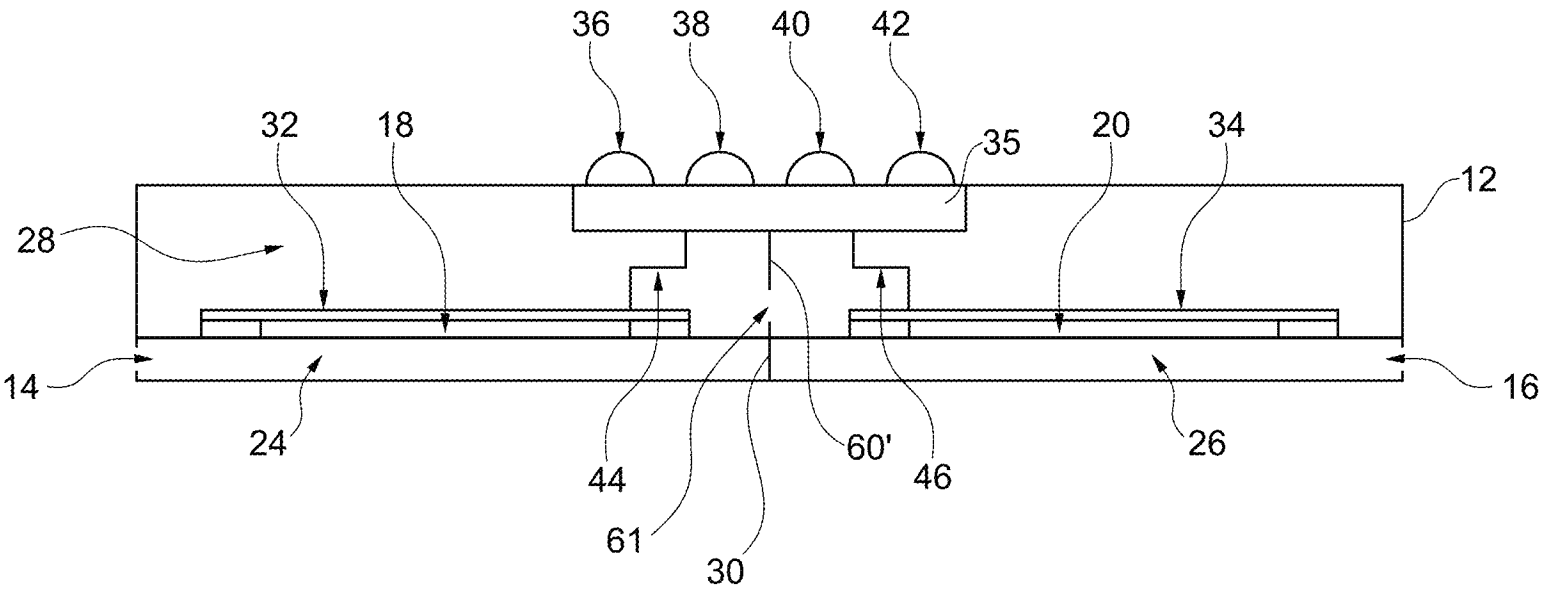
FIG. 4 illustrates a fourth embodiment of a transducer according to the invention.

In the embodiment illustrated in FIG. 4, compared to that illustrated in FIG. 1, a sound filtering element (60') is provided in the common rear volume so as to filter sound travelling in the common rear volume between the two membranes. This sound filtering element may be a wall with a sound opening where the wall thickness and the sound opening dimensions will define the filtering characteristics. Other types of elements may be channels, tubes, foams, grids, volumes or the like.

The skilled person is aware that when conducting the sound in a channel or element the dimensions of which will determine the filtering. The channel may be short or long, narrow or wide, have the same overall dimension along the length or a variation thereof. This is a matter of design choice.

Preferably, the sound filtering element is a low pass element. The cut-off threshold may be any frequency desired. Possible frequencies are mentioned above.

An alternative would be, as is also described further above, having the sound filtering element operate as a high pass filter or a band pass filter.

By means of the acoustical filter between the two membranes, the sensitivity can be shaped. For instance the acoustical filter can be made in such a way that the membranes are only coupled up to a certain frequency (low pass). Above this frequency the module behaves like a matched pair of microphones, which is a pair of identical microphones between which no interaction takes place.

Figure 5:
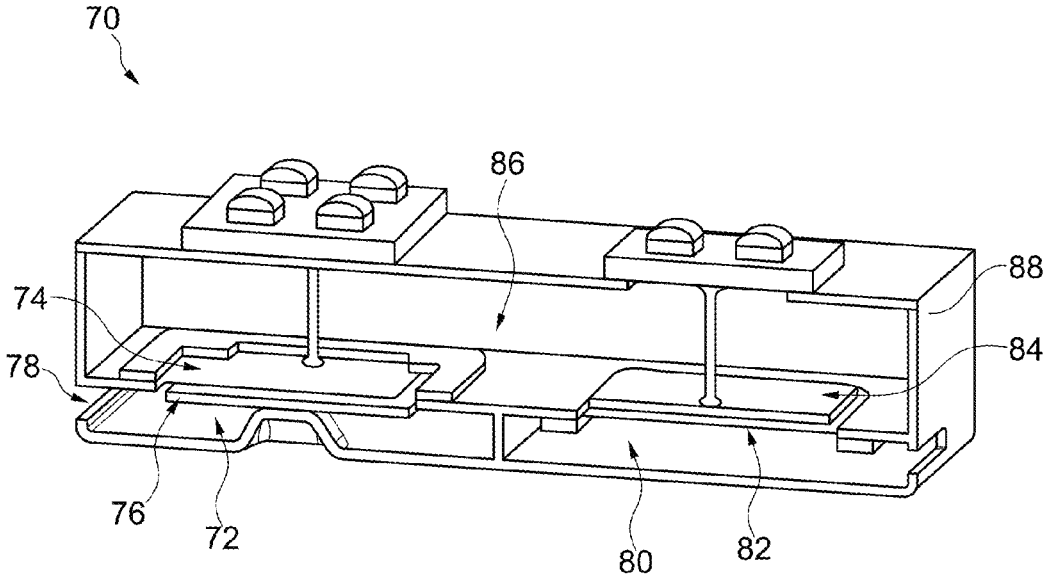
FIG. 5 illustrates a fifth embodiment of a transducer according to the invention.

FIG. 5 illustrates a transducer wherein two different set ups of a cartridge are shown. A cartridge designates a combination of diaphragm i.e. membrane and a signal provider i.e. a backplate that together provide the conversion of sound pressure to movement of charge, which in turn is converted to a voltage in the IC. For the first compartment (72), the membrane 1 (74) and back plate 1 (76) are arranged with the backplate positioned in the first compartment (72). For the second compartment (80), the membrane 2 (82) and back plate 2 (84) are arranged with the backplate positioned in the common compartment (86). The position of the backplate is not of influence on the signal provided. Hence, the arrangement for both the first and second compartment (72, 80) may be the same, such that backplates are positioned in the common compartment or the backplates are in the respective first and second front compartments.

A consequence of the difference in structure of the embodiment of FIG. 5 over that of FIG. 1 is that vibrations of the housing (88) causing movement of both membranes will result in signals in counterphase, which cancel each other out when summed in omnidirectional mode.

Figure 6:
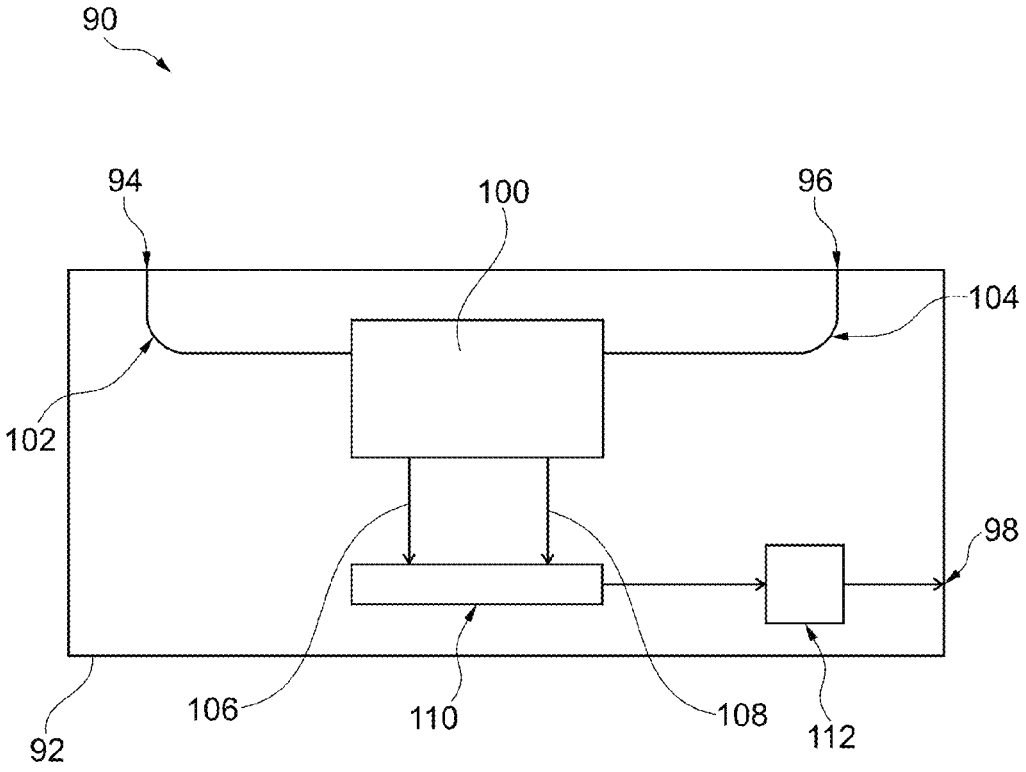
FIG. 6 illustrates a first embodiment of a hearing aid according to the invention.

FIG. 6 illustrates a hearing aid (90) having a hearing aid housing (92) having two hearing aid inputs, HA input 1 (94) and HA input 2 (96) and a hearing aid sound output (98), HA sound output. Inside the hearing aid is provided a transducer (100) according to any of FIGS. 1-5 as well as sound guides, sound guide 1 (102) and sound guide 2 (104), for guiding sound from the hearing aid inputs to the inputs of the transducer. The transducer outputs two outputs, such as the Mic_1 (106) and Mic_2 (108) outputs or the above omnidirectional and directional outputs to a processor (110), which therefrom generates an output for a sound generator (112) outputting the generated sound through the hearing aid sound output.

Figure 7:
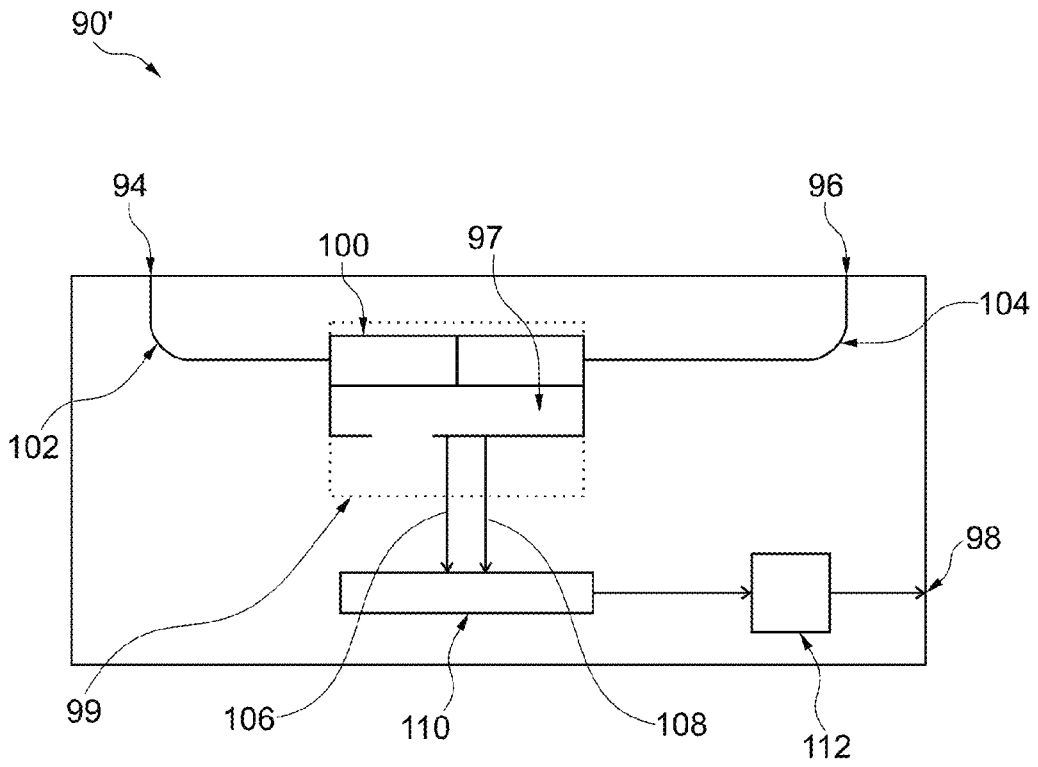
FIG. 7 illustrates a second embodiment of a hearing aid according to the invention.

FIG. 7 illustrates a hearing aid (90') having a hearing aid transducer compartment (99) wherein a transducer (100) is provided. In this embodiment, an inner surface of the hearing aid transducer compartment (99) takes part in delimiting the common compartment (97) of the transducer.

Figure 8:
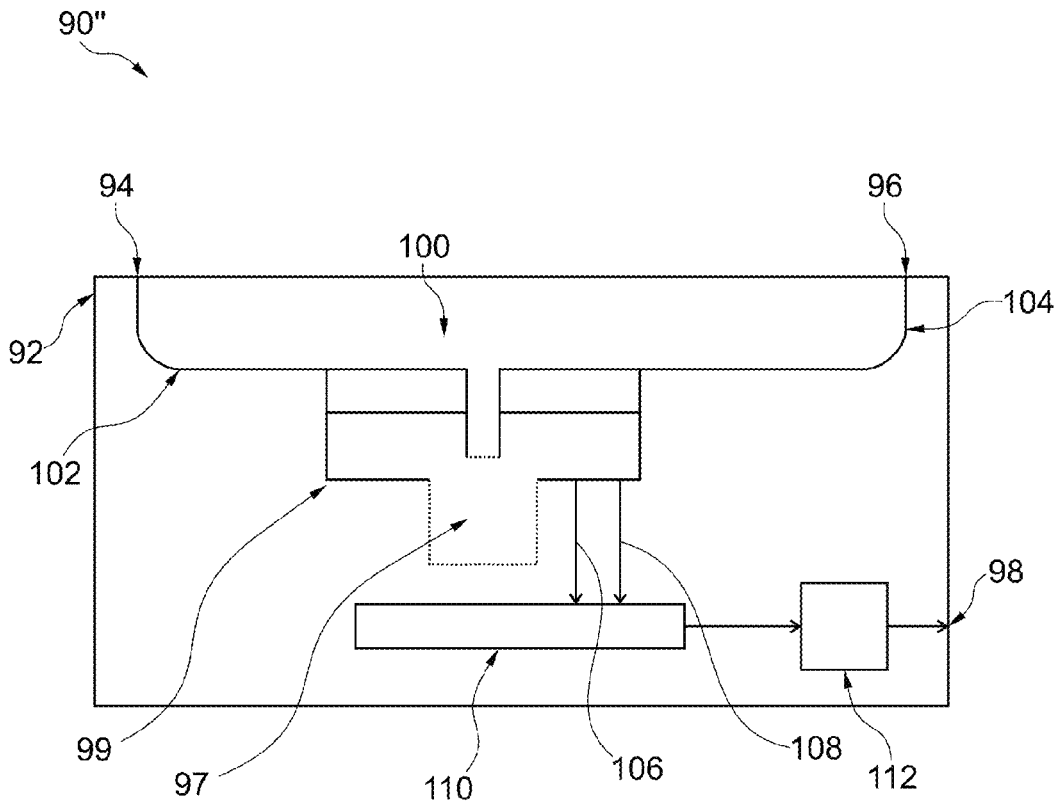
FIG. 8 illustrates a third embodiment of a hearing aid according to the invention.

FIG. 8 illustrates a hearing aid (90") wherein the transducer housing comprises two housing portions that are positioned in the hearing aid transducer compartment (99) such that the inner surface of the hearing aid transducer compartment (99) again takes part in delimiting the common compartment (97) of the transducer (90"). Part of the inner volume enclosed by the hearing aid transducer compartment (99) by which the common compartment (97) is extended provides an increase of the total common volume. The additional volume influences the ratio of the acoustical compliance of the diaphragm and the acoustical compliance of the rear volume, which, in turn, provides a measure for the improvement in directional performance over a matched pair microphone.

In general, in a directional mode, a transducer with two membranes and a common compartment as described above outperforms a matched pair with comparable membrane compliance, portspacing and outside dimensions for two reasons. Firstly, the two membranes are acoustically coupled by the common compartment. Due to the acoustical coupling, a deflection of membrane 1 leads to a crosstalk deflection of membrane 2 and vice versa. Since the crosstalk is in counter phase to the original signal the acoustical coupling leads to a gain in sensitivity in directional mode where the outputs of both membranes are subtracted from each other. The acoustical coupling leads to an improvement in directional sensitivity compared to a matched pair of factor $1+\chi$, where x is a measure for the acoustical coupling. Secondly, the effective acoustical compliance of a transducer with common compartment is higher than the effective acoustical compliance of an omni-directional microphone in a matched pair. If the common compartment is twice the size of the rear volume of one omni-directional microphone of a matched pair, the gain in directional sensitivity caused by the bigger volume and the second membrane equals $$\frac{1}{1-\chi}.$$

Both effects together are described in the following formula:

$$\frac{S_{dir}^{TCC}}{S_{dir}^{MP}} = \frac{1+\chi}{1-\chi} = 1 + \frac{C_D}{C_{RV}}$$

Herein is $S_{dir}^{TCC}$ the sensitivity of a transducer with common compartment in directional mode. $S_{dir}^{MP}$ is the sensitivity of a matched pair in directional mode. $C_D$ is the acoustical compliance of each membrane of the transducer with common compartment and also the acoustical compliance of the membrane of each omni-directional microphone of the matched pair. $C_{RV}$ is the acoustical compliance of the rear volume of one omni-directional microphone of the matched pair. The common compartment of the transducer with common compartment has an acoustical compliance of 2 times $C_{RV}$. The expression is only valid if the matched pair and the transducer with common compartment have the same port spacing. The gain in directional sensitivity leads to a gain in Signal-to-Noise-ratio in the low frequencies in directional mode.

For example, for a minimum gain of 0.5 dB the ratio of $C_D/C_{RV}$ should be larger than 0.05. Or, when the ratio is expressed $C_D/C_{CC}$, with $C_{CC}=2*C_{RV}$, this ratio should be larger than 0.025. The acoustical compliance of a compartment can be calculated from its volume, as is known to a person skilled in the art.

| | $C_D$ | $C_{RV}$ | $C_{CC}$ | Max. Common volume for min. 0.5 dB gain |
|---|---|---|---|---|
| Typical MEMS | 10 | 200 | 400 | 56 $mm^3$ |
| Typical Electret | 100 | 2000 | 4000 | 560 $mm^3$ |

The numbers are by approximation only.

In an added omni-mode, where the outputs of both membranes are added, the crosstalk leads to a reduction of sensitivity compared to a matched pair by a factor of $1-\chi$. This effect is compensated by the higher effective acoustical compliance of the transducer with common compartment:

$$\frac{S_{added\ omni}^{TCC}}{S_{added\ omni}^{MP}} = \frac{1-\chi}{1-\chi} = 1$$

Herein is $S_{added\ omni}^{TCC}$ the sensitivity of the transducer with common compartment in the added Omni-Mode and $S_{added\ omni}^{MP}$ is the sensitivity of the matched pair in the added Omni-Mode.

However, the amount of crosstalk may influence the omni-directional sensitivity such that the omni-directional performance is compromised, i.e., the polar plot of the microphone no longer shows full omni-directional sensitivity. The change in omni-directional performance is frequency dependent and first occurs at high frequencies. This occurs for example for a crosstalk of 0.9 already at frequencies of 4 kHz and higher. For crosstalk higher than 0.9, it occurs even below 4 kHz. As a classical audio frequency range as applicable for hearing aids goes up to 4 kHz, a crosstalk up to 0.9 would still provide sufficient omni-directional performance. Values for the ratio of the acoustical compliance of the membrane $C_D$ and acoustical compliance of the common chamber $C_{CC}$, and the associated crosstalk $\chi$ are presented in the table below:

| | Lower Limit | | Upper Limit |
|---|---|---|---|
| Cd/Crv | 0.050 | 8 | 18 |
| Cd/Ccc | 0.025 | 4 | 9 |
| X | 0.024 | 0.8 | 0.9 |

This shows that for a transducer designed to have a ratio Cd/Ccc=4, the crosstalk would be 0.8, and would still provide sufficient performance in omni-directional mode.

Thus, the performance of a transducer as described can be expressed by the ratio of the acoustical compliance of one of the diaphragms and the acoustical compliance of the common compartment as follows:

$$\frac{C_D}{C_{CC}}.$$

Operational performance in directional mode determines a lower limit, preferably 0.025. Operational performance in omni-directional mode determines an upper limit, preferably 9 and more preferably 4. This can be expressed in the following equation:

$$0.025 < \frac{C_D}{C_{CC}} < 9$$

or more preferably $$0.025 < \frac{C_D}{C_{CC}} < 4$$

Figure 9:
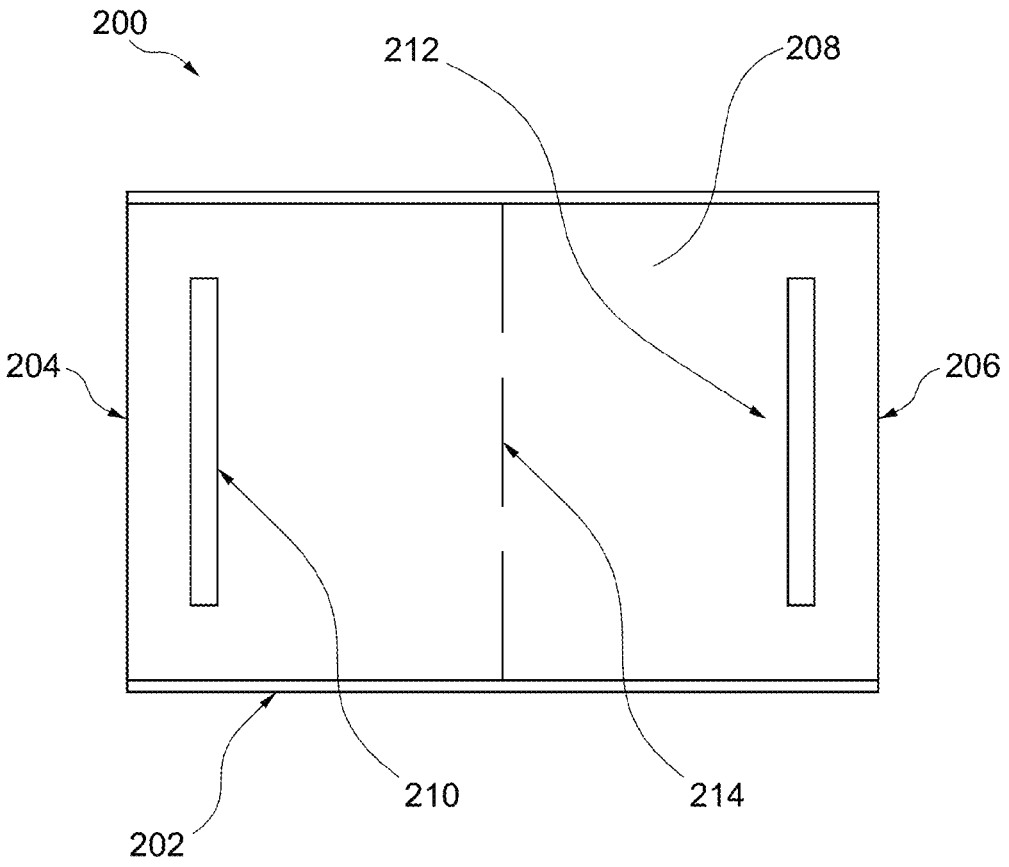
FIG. 9 illustrates a transducer having no front volumes.

FIG. 9 illustrates an interesting embodiment (200) of the invention wherein the transducer simply comprises a housing (202) having two membranes (204, 206) together defining a compartment (208). In relation to the membranes, backplates (210, 212) are provided to output signals corresponding to the movement/vibration of the membranes. These backplates, naturally, may be provided on the outer sides of the membranes if desired. The processor, etc., are not illustrated to provide simplicity to the figure.

In this embodiment, the mere physical distance between the membranes may provide the directional properties that are sought. When used in the hearing aid of FIG. 6, the transducer of FIG. 9 may be provided in a compartment within the housing of the hearing aid, and this compartment may define the front volumes of, for example, FIG. 1, or the sound guides themselves may define such spaces or compartments.

Naturally, also this embodiment may have the sound filtering element illustrated (214).

The processor may, if required, generate the omnidirectional signal and/or directional signal, if these are not generated by the transducer. Additionally or alternatively, the processor may further filter and/or amplify a signal in order for it to be suitable for the sound generator and/or the hearing problem of a user of the hearing aid.

Naturally, the directivity of the transducer is along a line between the two hearing aid sound inputs, whereby the positioning of such inputs may be of interest. In one situation, the hearing aid sound inputs are provided on a BTE unit positioned on or at an ear of the user, whereas the sound generator and/or the sound output may be provided in or at the ear canal of the user, such as in an ITE unit.

The processor may be provided inside the transducer if desired, so that only the output for the sound generator may be provided on the transducer (in addition to e.g. a power input). Also, inputs may be provided for controlling a processing of the signal for the sound generator, such a volume signal, a filtering signal and perhaps an on/off signal.

Diaphragms or membranes applied in the transducer and hearing aids as described above may be made up of a single piece e.g. of Mylar film, but also of several pieces joined together.

In microphones, the rear volume is normally vented by a vent hole, either in at the diaphragm or in the casing, for air pressure compensation. In the transducer as described above, a vent hole in a single diaphragm would suffice instead of both diaphragms.

Figure 10:
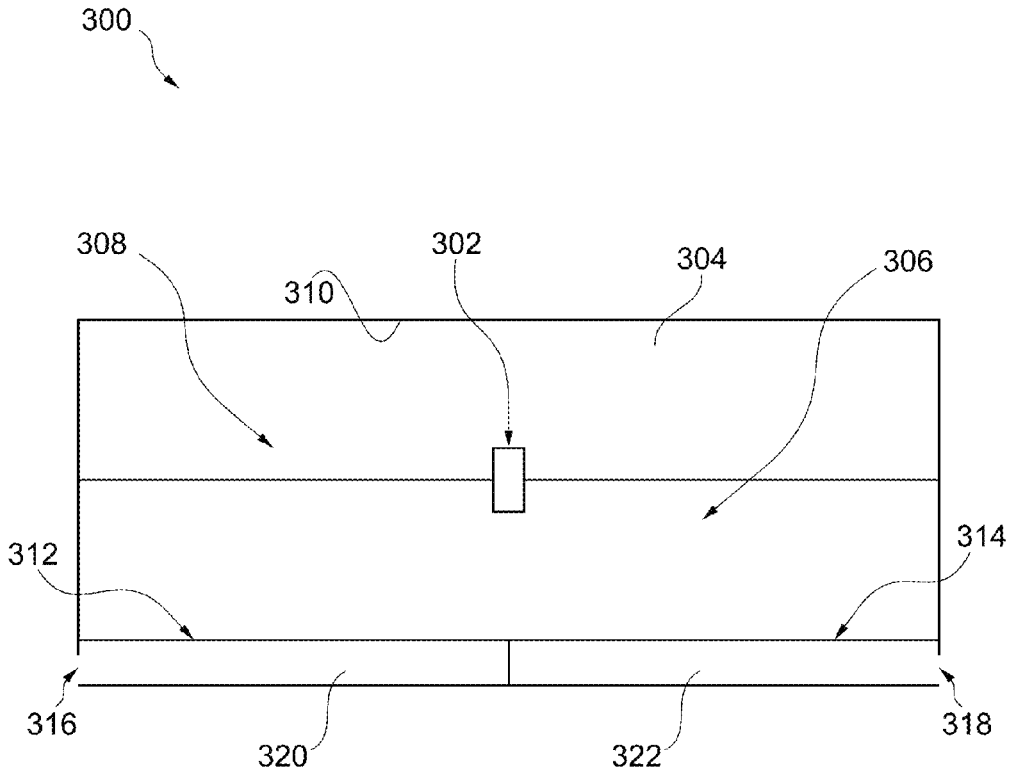
FIG. 10 illustrates a transducer according to the invention having a sound filter.

FIG. 10 illustrates an embodiment of the invention wherein the transducer comprises a sound filtering element (302) dividing the common compartment (304) into a third compartment (306) and a fourth compartment (308). The third compartment (306) is delimited by the sound filtering element, part of the inner surface (310), the first diaphragm (312) and the second diaphragm (314). The fourth compartment (308) is delimited by the sound filtering element and a part of the inner surface, but not the first and the second diaphragm. Front chambers (320, 322) are defined on the other sides of the membranes and inputs (316, 318) open into the front chambers.

Thus, the filter provides a cut-off frequency above which the membranes only see the third compartment and below the cut-off frequency see the sum of the third and fourth compartment. The cut-off frequency is preferably below the resonance frequency of the microphone including the common compartment, i.e. the volume enclosed by both the third and fourth compartment. This extends the directional performance also into the higher frequency range of the audio spectrum, such as 4 kHz. and higher.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A transducer comprising:

a housing comprising an inner surface;

a first diaphragm and a second diaphragm each positioned in the housing, the first and second diaphragms and the inner surface of the housing at least partly defining a common compartment within the housing, the common compartment lacking an acoustic filter that filters sound travelling in the common compartment between that first and second diaphragms;

a first signal provider and a second signal provider, the first signal provider being configured to convert movement of the first diaphragm into a first signal, the second signal provider being configured to convert movement of the second diaphragm into a second signal; and wherein a ratio of an acoustical compliance of the first diaphragm to an acoustical compliance of the common compartment is in a range of 0.025 to 9, and a ratio of an acoustical compliance of the second diaphragm to the acoustical compliance of the common compartment is in a range of 0.025 to 9.

2. A transducer according to claim 1, wherein the housing has an opening allowing sound from the surroundings of the housing to impinge on the diaphragms.

3. A transducer according to claim 1, wherein the first and second diaphragms are positioned in respective openings.

4. A transducer according to claim 1, wherein the common compartment is acoustically sealed from surroundings of the housing.

5. A transducer according to claim 1, wherein the first and second diaphragms each have a first and a second side, the second sides facing the common compartment.

6. A transducer according to claim 5, wherein the housing further comprises a first and a second compartment and the openings comprise first and a second sound openings that open into the first and second compartment, respectively, the first side of the first diaphragm defining, with at least a part of the inner surface, the first compartment and the first side of the second diaphragm defining, with at least a part of the inner surface, the second compartment.

7. A transducer according to claim 1, further comprising:

at least one further diaphragm delimiting the common compartment, the diaphragm having first and second sides, the second side facing the common compartment;

at least one further signal provider, the further signal provider being configured to convert movement of the further diaphragm into a further signal; and wherein, the openings comprise at least one further opening that opens into the respective at least one further compartment.

8. A transducer according to claim 7, wherein the housing comprises at least one further compartment defined by the first side of the further diaphragm and at least a part the inner surface.

9. A transducer according to claim 1, further comprising a processor configured to receive the first and the second signals and output a third signal and a fourth signal, the third signal being based on an addition of the first and second signals and the fourth signal being based on a subtraction of the first and second signals.

10. A transducer according to claim 9, wherein the processor is configured to provide the fourth signal by initially time delaying one of the first and second signals and subsequently subtracting the time delayed first or second signal and the other of the first and second signals.

11. A transducer according to claim 9, wherein the processor is configured to provide the third signal by initially time delaying one of the first and second signals and subsequently adding the time delayed first or second signal and the other of the first and second signals.

12. A transducer according to claim 1 , wherein the ratio of the acoustical compliance of the first diaphragm and the acoustical compliance of the common compartment is in a range of 0.025 to 4.

13. A transducer according to claim 1, in combination with a hearing aid that comprises:

a hearing aid housing comprising a first and a second hearing aid sound inputs and a hearing aid transducer compartment in which the transducer is positioned;

a sound generator; and a processor configured to receive the first and second signals and output an output signal for the sound generator based on the first and second signals.

14. A transducer and hearing aid combination according to claim 13, further comprising:

a first sound guide configured to transport sound from the first hearing aid sound input to the first diaphragm; and a second sound guide configured to transport sound from the second hearing aid sound input to the second diaphragm.

15. A transducer and hearing aid combination according to claim 13, wherein the common compartment is further delimited by at least a part of an inner surface of the hearing aid transducer compartment.

16. A method of operating the transducer having a housing comprising an inner surface and first and second diaphragms that, together with the inner surface, at least partly define a common compartment, the transducer further having a first signal provider configured to convert movement of the first diaphragm into a first signal and a second signal provider configured to convert movement of the second diaphragm into a second signal, a ratio of an acoustical compliance of the first diaphragm and an acoustical compliance of the common compartment being in a range of 0.025 to 9, and a ratio of an acoustical compliance of the second diaphragm to the acoustical compliance of the common compartment being in a range of 0.025 to 9, the method comprising:

in an omnidirectional mode of operation in which sound is permitted to travel within the common compartment between that first and second diaphragms without encountering an acoustic filter, generating and outputting a third signal from (i) either one of the first and second signals or (ii) an addition of the first and second signals; and in a directional mode of operation in which sound is permitted to travel within the common compartment between that first and second diaphragms without encountering an acoustic filter, generating and outputting a fourth signal from a subtraction of the first signal from the second signal.

17. A transducer according to claim 1, wherein the first diaphragm and the second diaphragm are positioned on opposite sides of the housing and facing each other within the common compartment.

18. A transducer according to claim 1, wherein the first diaphragm and the second diaphragm having the same acoustical compliance.

19. A transducer according to claim 1, wherein the first diaphragm and the second diaphragm are made from a single piece of material.

20. A transducer according to claim 1, wherein the common compartment is in communication with a vent allowing passage of air into and out of the common compartment.

21. A transducer comprising:

a housing comprising an inner surface;

a first diaphragm and a second diaphragm each positioned in the housing, the first and second diaphragms and the inner surface at least partly defining a common compartment within the housing, the common compartment lacking an acoustic filter that filters sound travelling in the common compartment between that first and second diaphragms, a ratio of an acoustical compliance of the first diaphragm to an acoustical compliance of the common compartment being in a range of 0.025 to 9, a ratio of an acoustical compliance of the second diaphragm to the acoustical compliance of the common compartment being in a range of 0.025 to 9, a first signal provider and a second signal provider, the first signal provider being configured to convert movement of the first diaphragm into a first signal, the second signal provider being configured to convert movement of the second diaphragm into a second signal; and a processor located within the housing, the processor receiving the first signal from the first signal provider and the second signal from the second signal provider, the processor being configured to provide an omnidirectional output signal based on (i) either one of the first and second signals or (ii) the addition of the first and second signals, the processor being further configured to provide a directional output signal based on the subtraction of the first signal from the second signal.

* * * * *